United States Patent [19]

Matsuhisa

[11] Patent Number: 4,957,813

[45] Date of Patent: Sep. 18, 1990

[54] PRESSURE-SENSITIVE TRANSFER MEMBER

[75] Inventor: Hirohide Matsuhisa, Yokohama, Japan

[73] Assignee: Canon Kabushiki Kaisha, Tokyo, Japan

[21] Appl. No.: 241,207

[22] Filed: Sep. 7, 1988

[30] Foreign Application Priority Data

Sep. 8, 1987 [JP] Japan ..... 62-222973

[51] Int. Cl.[5] ..... B41M 5/03

[52] U.S. Cl. ..... 428/336; 428/195; 428/474.4; 428/500; 428/914

[58] Field of Search ..... 428/195, 207, 336, 474.4, 428/478.8, 514, 522, 535, 914, 500

[56] References Cited

U.S. PATENT DOCUMENTS 3,169,880 2/1965 Strauss ..... 428/914
3,203,832 8/1965 Mino et al. ..... 428/914

OTHER PUBLICATIONS

K. L. Hoy, "New Value of the Solubility Parameters From Vapor Pressure Data", J. of Paint Technology, vol. 42, No. 541, p. 76 (Feb. 1970).

P. A. Small, "Some Factors Affecting the Solubility of Polymers", J. Applied Chemistry, vol. 3, 71 (Feb. 1953).

*Primary Examiner*—Pamela R. Schwartz

*Attorney, Agent, or Firm*—Fitzpatrick, Cella, Harper & Scinto

[57] ABSTRACT

A pressure-sensitive transfer member has an ink layer comprising a pressure-sensitive transferable ink composition containing an oil component and a resin component provided on a substrate, characterized in that the respective solubility parameters $\delta_O$, $\delta_B$ of the oil and the resin satisfy the following relationship:

$$\delta_B - 1.30 < \delta_O < \delta_B - 0.80.$$

6 Claims, No Drawings

PRESSURE-SENSITIVE TRANSFER MEMBER

BACKGROUND OF THE INVENTION

1. Field of the Invention

This invention relates to a novel pressure-sensitive transfer member which can give sufficiently sharp transferred images even at a low impact energy.

2. Related Background Art

There have been heretofore known pressure-sensitive transfer members for transfer recording letters, etc. on a member to be attached such as paper, etc. by utilizing an impact energy by a type bar or a print ball, etc. The impact printer utilizing a pressure-sensitive transfer material, while it is capable of higher speed printing as compared with an impact printer of the pressure-sensitive or current-passage system utilizing heat energy, a great impact energy is required during printing on the other hand, thus involving the drawback of great noise during printing operation.

In recent years, with the progress of development of information instruments, there is increasingly a demand for low noise in printing working, and an impact printer utilizing daisy wheel has been widely employed in place of the type bar or print ball as described above. However, even in an impact printer utilizing daisy wheel, an impact energy of about 10 $mJ/mm^2$ on an average is required during printing, and the noise accompanied therewith has not been reduced to the extent as in the case of the pressure-sensitive or current-passage system impact printer under the present situation.

Under such circumstances, recently in printing by an impact printer, for the purpose of making the noise further lower, during printing by means of the above impact printer utilizing the daisy wheel, it has been proposed to reduce the impact energy. However, when printing is effected with reduced impact energy by use of the pressure-sensitive member of the prior art, transfer badness such as letter defect or shortage of sharpness, etc. will generally occur.

On the other hand, it has been also practiced to attempt reduction of impact energy after weakening the adhesive force between the substrate and the ink layer constituting the pressure-sensitive transfer member, but such a pressure sensitive member will suffer from the back transfer phenomenon (or blocking) in which the ink layer is plastered onto the back surface of the substrate when it is wound up in a ribbon for use as the ink ribbon.

Thus, up to date, the problems antagonistic to each other of transfer performance and the back transfer phenomenon concerning the adhesiveness between the substrate and the ink layer of the pressure-sensitive transfer member remain to be solved under the present situation.

Whereas, the substrate of the pressure-sensitive transfer member for ink ribbon for impact printer, etc. as described above is generally made a film, and the ink layer provided thereon is composed mainly of a resin capable of forming a coating and a low volatile oil which will not plasticize the resin. Concerning the printing mechanism of such pressure-sensitive transfer member, much remain still to be clarified, but generally speaking, by giving an impact energy overcoming the adhesive force between the substrate and the ink layer to the ink ribbon during printing, agglomeration breaking of the oil existing in spots in the ink occurs first, followed subsequently by breaking of the resin existing in porous film in the ink layer simultaneously with migration of the oil onto the ink layer surface, whereby adhesion of the ink layer, namely printing, onto the member to be attached is considered to occur.

Accordingly, in order to realize low noise of the impact printer by use of such a pressure-sensitive transfer material without causing the problems of transfer badness such as letter defect, etc. or back transfer phenomenon, it is necessary to prevent letter defect or lowering in sharpness by making smaller the adhesive force between the substrate and the ink layer to the extent corresponding to reduction in impact energy, and at the same time maintain the adhesive force to the extent which will not cause the back transfer phenomenon as a problem antagonistic thereto, namely to consider the balance of the adhesive force between the substrate and the ink layer.

As a factor which may be considered to have great influence on the adhesive force, there may be considered the degree of compatibility between the resin and oil components contained in the layer. If the degree of compatibility is low, tackiness between the resin and oil is weakened, whereby the adhesive force between the substrate and the ink layer will be consequently weakened. In the pressure-sensitive transfer member for light hitting of the prior art, only an oily substance substantially incompatible with the resin component has been used as the oil. For this reason, although the adhesive force between the substrate and the ink layer could be weakened corresponding to reduction in impact energy, the back transfer phenomenon could not be fundamentally cancelled.

SUMMARY OF THE INVENTION

An object of the present invention is to provide a pressure sensitive member which can exhibit good transfer performance even at a low impact energy.

Another object of the present invention is to provide a pressure-sensitive member which can exhibit good transfer performance even at a low impact energy without causing the back transfer phenomenon.

According to the present invention, there is provided a pressure-sensitive transfer member having an ink layer comprising a pressure sensitive transferable ink composition containing an oil component and a resin component provided on a substrate, characterized in that the respective solubility parameters $\delta_O$, $\delta_B$ of the oil and the resin satisfy the following relationship:

$$\delta_B - 1.30 < \delta_O < \delta_B - 0.80.$$

More specifically, the pressure-sensitive transfer material of the present invention maintains the adhesive force between the substrate and the ink layer within an adequate range by limiting the compatibility between the resin and the oil in the ink composition by the solubility parameters within a certain range. Generally speaking, the solubility parameter $\delta$ has been frequently used as the index in choosing compatibilitY mutually between the resins and a solvent for a resin, and compatibility is deemed to be better as the values of solubility parameters between the both are more approximate to each other.

In the pressure-sensitive transfer member having such characteristics, good transfer performance could be exhibited even at a low impact energy as 3 $mJ/mm^2$ and yet no back transfer phenomenon is observed at all.

When the solubility parameters of the resin and the oil are outside of this range, for example:

$$\delta_B - 0.80 < \delta_O$$

the adhesive force between the substrate and the ink layer is increased too high, whereby transfer becomes impossible at low impact energy, while the adhesive force between the member to be attached and the ink layer is increased too high when used as a correctable type transfer member, whereby lift-off correction by low impact energy will become impossible.

On the other hand, in case of $$\delta_B - 1.30 > \delta_O,$$

although transfer may be possible at low impact energy, the letter quality is lacking in sharpness, and still worse, back transfer phenomenon will occur.

The solubility parameters $\delta_B$, $\delta_O$ as mentioned above can be determined directly from vaporization latent heat, vapor pressure, critical pressure or coefficient of thermal expansion.

However, their values can be determined most simply by use of the intramolecular attraction constants as reported by Small, Hoy et al.

In the Examples shown below, the intramolecular attraction constant G determined by Hoy et al was used. Also, when the resin and the oil used are in mixtures, the solubility parameter can be determined simply by:

$$\delta_{MIX} = x_1\delta_1 + x_2\delta_2 + x_3\delta_3 \ldots + x_n\delta_n$$

$x_n$: mol fraction of component n $\delta_n$: solubility parameter of component n

DESCRIPTION OF THE PREFERRED EMBODIMENTS

The upper limit of the solubility parameter of the oil may be more preferably $\delta_B - 0.80 > \delta_O$. The ink layer may be formed of the main components comprising a coating forming resin to be used in the known pressure-sensitive transfer member (e.g. polyamide resin, acrylic resin, cellulose derivative, various vinyl resins, etc.) and an oil (oily substance) having a $\delta$ value satisfying the above range. In the ink layer, there may be also added various additives, if desired. The ink layer to be laminated on the substrate may preferably have a thickness of about 1 to 3 $\mu$m.

In the present invention, for the oil to be incorporated in the ink layer, various oils can be utilized depending on the resin component used. For example, for a resin component which is a polyamide having about $\delta_B = 11$, an oil having about $9.5 \leqq \delta_O \leqq 10.5$ is preferred. More preferably, an oil having around $\delta_O = 9.7$ may be used.

In the present invention, the oil may be desirably employed at a proportion of about 30 to 60% by weight based on the ink solids. Further, such an oil may have any chemical structure, provided that it satisfies the $\delta_O$ value as described above, but may desirably be a substance which is liquid with a relatively lower viscosity at room temperature and stable chemically and thermally. Specific examples of such oil may include polyethers such as polyethylene glycol, propylene glycol, etc . fatty acid esters such as butyl stearate, butyl palmitate, etc.. aromatic esters such as dibutyl phthalate, dioctyl phthalate, etc., hydrocarbons such as cycloparaffine, isoparaffine, etc.

As the substrate constituting the transfer member of the present invention, there can be employed broadly substrates of various materials and shapes, such as plastic films used in known pressure-sensitive transfer members, etc. However, preferably, polyolefin plastic films such as polyethylene, polypropylene, etc. can be utilized. The substrate may have a thickness preferably of about 4 to 25 $\mu$m in the ink layer laminated direction.

EXAMPLE 1

| | |
|---|---|
| Dimer acid type polyamide | 20 parts ($\delta_B$ = 9.23) |
| Fluid paraffin #80 | 18 parts ($\delta_{01}$ = 7.90) |
| Isopropyl myristate | 6 parts ($\delta_{02}$ = 8.14) |
| | *$\delta_{O\,MIX}$ = 7.96 |
| Carbon black | 9 parts |
| Toluene | 50 parts |
| Isopropyl alcohol | 180 parts |

To 20 parts of a dimer acid type polyamide resin ($\delta_B$=9.23) which is the binder component were added 100 parts of isopropyl alcohol and 20 parts of toluene and the resin was completely dissolved therein by heating with stirring. Then, to the solution were added 18 parts of a fluid paraffin #80 ($\delta_O$=7.90) which is the oil component, followed by addition of 6 parts of isopropyl myristate ($\delta_O$=8.14), 9 parts of carbon black which is the colorant, 80 parts of isopropyl alcohol and 30 parts of toluene which are solvents, and the mixture was dispersed by a sand grinder for 20 minutes to give the above ink composition (I) having a uniform composition.

The ink composition was applied by a roll coater on a polyethylene film with a film thickness of 14 $\mu$m to a coated amount after drying of about 25 g/m$^2$, and dried in a drying furnace at a temperature range from 30° to 80° C. The polyethylene film having the ink composition thus laminated thereon was cut into 8 mm width, and wound up on a core to give a heat-sensitive transfer member of the present invention.

EXAMPLE 2

| | |
|---|---|
| Dimer acid type polyamide | 20 parts ($\delta_B$ = 9.23) |
| Fluid paraffin #80 | 22 parts ($\delta_{01}$ = 7.90) |
| Dibutyl phthalate | 2 parts ($\delta_{02}$ = 8.14) |
| | *$\delta_{O\,MIX}$ = 8.04 |
| Carbon black | 9 parts |
| Toluene | 50 parts |
| Isopropyl alcohol | 180 parts |

A pressure-sensitive transfer member of the present invention was obtained according to entirely the same procedure as in Example 1 except for using 22 parts of a fluid paraffin #80 and 2 parts of dibutyl phthalate in place of 18 parts of a fluid paraffin #80 and 6 parts of isopropyl myristate.

EXAMPLE 3

| | |
|---|---|
| Dimer acid type polyamide | 20 parts ($\delta_B$ = 9.23) |
| Isopropyl palmitate | 24 parts ($\delta_O$ = 8.12) |

-continued

| | |
|---|---|
| Carbon black | 9 parts |
| Toluene | 50 parts |
| Isopropyl alcohol | 180 parts |

A pressure sensitive transfer member of the present invention was obtained according to entirely the same procedure as in Example 1 except for using 24 parts of isopropyl palmitate in place of 18 parts of a fluid paraffin #80 and 6 parts of isopropyl myristate.

Comparative example 1

| | | |
|---|---|---|
| Dimer acid type polyamide | 20 parts ($\delta_B = 9.23$) | |
| Fluid paraffin #80 | 12 parts ($\delta_{01} = 7.90$) | * |
| Dibutyl phthalate | 12 parts ($\delta_{02} = 9.62$) | * |
| | *$\delta_{O\ MIX} = 8.76$ | |
| Carbon black | 9 parts | |
| Toluene | 50 parts | |
| Isopropyl alcohol | 180 parts | |

A pressure sensitive transfer member of the prior art example was obtained according to entirely the same procedure as in Example 2 except for using 12 parts of a fluid paraffin #80 and 12 parts of dibutyl phthalate in place of 22 parts of a fluid paraffin #80 and 2 parts of dibutyl phthalate.

Comparative example 2

| | |
|---|---|
| Dimer acid type polyamide | 20 parts ($\delta_B = 9.23$) |
| Polyethylene glycol 200 (PEG-200) | 24 parts ($\delta_O = 11.55$) |
| Carbon black | 9 parts |
| Toluene | 50 parts |
| Isopropyl alcohol | 180 parts |

A pressure-sensitive transfer member of the prior art example was obtained according to entirely the same procedure as in Comparative example 1 except for using 24 parts of a polyethylene glycol 200 (PEG200) in place of 12 parts of a fluid paraffin #80 and 12 parts of dibutyl phthalate.

COMPARATIVE EXAMPLE 3

| | |
|---|---|
| Dimer acid type polyamide | 20 parts ($\delta_B = 9.23$) |
| Fluid paraffin #60 | 24 parts ($\delta_O = 7.89$) |
| Carbon black | 9 parts |
| Toluene | 50 parts |
| Isopropyl alcohol | 180 parts |

A pressure-sensitive transfer member of the prior art example was obtained according to entirely the same procedure as in Comparative example 2 except for using 24 parts of a fluid paraffin #60 in place of 24 parts of a polyethylene glycol 200 (PEG-200).

Each of the pressure-sensitive transfer members obtained in Examples and Comparative examples was mounted as the ink ribbon for typewriter on a daisy wheel type typewriter (AP-560, produced by Canon), and printing was performed under the conditions of an environmental temperature of 20° C. and an environmental humidity of 50% at a printing energy in the range of 2.5 mJ/mm$^2$ to 15.0 mJ/mm$^2$. Table 1 shows the lowest printing energy at which a clear print image is given, as the lowest printing energy for that ribbon.

As the result, the ink ribbons obtained in Examples 1, 2 and 3 gave sharp printed images at 3.0, 3.5 mJ/mm$^2$ or higher, respectively, but the ribbons obtained in Comparative examples 1, 2 and 3 required 7 mJ/mm$^2$ or higher of energy for obtaining sharp printed images.

Separately, each of the transfer members obtained in Examples and Comparative examples was cut into 150 cm, and after wound up on a core under a load of 25 g, 50 g, 75 g and 100 g in the vertical direction, left to stand under the conditions of an environmental temperature of 45° C. and an environmental humidity of 95% for 45 hours. After this was returned to room temperature, occurrence of back transfer was evaluated by the back transfer length from the core portion to give the results shown in Table 2.

As the result, in both of the ribbons obtained in Example 1, 2 and 3 and the ribbons obtained in Comparative examples 1, 2 and 3, occurrence of back transfer was found to be at a level without any practical problem, thus exhibiting sufficient antiblocking property.

TABLE 1

| | Transferability test | | | | | | | | | | | |
|---|---|---|---|---|---|---|---|---|---|---|---|---|
| E* | 2.5 | 3.0 | 3.5 | 4.0 | 4.5 | 5.0 | 6.0 | 7.0 | 8.0 | 9.0 | 10.0 | 15.0 |
| Example 1 | X | O | O | O | O | O | O | O | O | O | O | O |
| Example 2 | X | Δ | O | O | O | O | O | O | O | O | O | O |
| Example 3 | X | X | O | O | O | O | O | O | O | O | O | O |
| Comparative Example 1 | X | X | X | X | X | X | X | Δ | O | O | O | O |
| Comparative Example 2 | X | X | X | X | X | X | X | X | X | O | O | O |
| Comparative Example 3 | X | X | X | X | X | X | X | O | O | O | O | O |

O Bad letter rate: 4% or less
Δ Bad letter rate: 4%-12%
X Bad letter rate: 12% or more
E* Transfer energy [mJ/mm$^2$]

TABLE 2

| | Back transfer test | | | |
|---|---|---|---|---|
| Load (g) | 25 | 50 | 75 | 100 |
| Example 1 | 0cm | 0cm | 2cm | 32cm |
| Example 2 | 0cm | 0cm | 0cm | 32cm |
| Example 3 | 0cm | 0cm | 0cm | 9cm |
| Comparative Example 1 | 0cm | 0cm | 0cm | 6cm |
| Comparative Example 2 | 0cm | 0cm | 0cm | 6cm |
| Comparative Example 3 | 0cm | 0cm | 6cm | 32cm |

As described in detail above, the pressure-sensitive transfer member of the present invention permits a sufficiently sharp transfer recorded image to remain even at a low impact energy, and yet exhibits a performance fairly equal to the pressure-sensitive transfer member of the prior art also in antiblocking property. The present invention provides a novel transfer medium exhibiting good transfer performance even at a low impact energy by controlling the adhesive force between the substrate and the ink layer from the aspect of compatibility between the resin and the oil used in the ink layer by utilizing the solubility parameter δ as the index.

What is claimed is:

1. A pressure-sensitive transfer member having an ink layer comprising a pressure-sensitive transferable ink composition containing colorant material, an oil component and a resin component provided on a substrate, characterized in that the respective solubility parameters $\delta_O$, $\delta_B$ of the oil and the resin satisfy the following relationship:

$$\delta_B - 1.30 < \delta_O < \delta_B - 0.80.$$

2. A pressure-sensitive transfer member according to claim 1, wherein the respective solubility parameters satisfy the following relationship:

$$\delta_B - 1.30 < \delta_O < \delta_B - 1.0.$$

3. A pressure-sensitive transfer member according to claim 1, wherein the resin component is at least one selected from polyamide resin, acrylic resin, cellulose resin and vinyl resin.

4. A pressure-sensitive transfer member according to claim 1, wherein the ink layer has a thickness of 1 to 3 μm.

5. A pressure-sensitive transfer member according to claim 1, wherein the oil content is 30 to 60 parts by weight based on 100 parts by weight of ink solids.

6. A pressure-sensitive transfer member according to claim 1, wherein the oil is at least one selected from polyethers, fatty acid esters, aromatic esters and hydrocarbons.

* * * * *

UNITED STATES PATENT AND TRADEMARK OFFICE

CERTIFICATE OF CORRECTION

PATENT NO. : 4,957,813

DATED : September 18, 1990

INVENTOR(S) : HIROHIDE MATSUHISA

It is certified that error appears in the above-identified patent and that said Letters Patent is hereby corrected as shown below:

COLUMN 1

Line 39, "badness" should read --impairment--.
Line 63, "remain" should read --remains--.

COLUMN 2

Line 8, "badness" should read --impairment--.
Line 60, "compatibilityY" should read --compatibility--.
Line 67, "at a" should read --at such a --.

Signed and Sealed this

Eighteenth Day of August, 1992

*Attest:*

DOUGLAS B. COMER

*Attesting Officer*

*Acting Commissioner of Patents and Trademarks*